US006546080B1

(12) United States Patent
Geitz

(10) Patent No.: US 6,546,080 B1
(45) Date of Patent: Apr. 8, 2003

(54) HEAT SINK FOR MINIATURE X-RAY UNIT

(75) Inventor: Kurt Alfred Edward Geitz, Sudbury, MA (US)

(73) Assignee: SciMed Life Systems, Inc., Maple Grove, MN (US)

( * ) Notice: Subject to any disclaimer, the term of this patent is extended or adjusted under 35 U.S.C. 154(b) by 12 days.

(21) Appl. No.: 09/709,668

(22) Filed: Nov. 10, 2000

(51) Int. Cl.[7] ..... H01I 35/12
(52) U.S. Cl. ..... 378/141; 378/199
(58) Field of Search ..... 378/65, 119, 121, 378/141, 199, 200

(56) References Cited

U.S. PATENT DOCUMENTS

| | | | | | |
|---|---|---|---|---|---|
| 3,992,633 | A | * | 11/1976 | Braun et al. | 378/2 |
| 4,641,649 | A | | 2/1987 | Walinsky et al. | |
| 4,652,846 | A | | 3/1987 | Sobottka | |
| 4,860,744 | A | | 8/1989 | Johnson et al. | |
| 4,993,404 | A | | 2/1991 | Lane | |
| 5,006,119 | A | | 4/1991 | Acker et al. | |
| 5,041,107 | A | | 8/1991 | Heil, Jr. | |
| 5,084,061 | A | | 1/1992 | Gau et al. | |
| 5,090,043 | A | * | 2/1992 | Parker et al. | 378/121 |
| 5,127,394 | A | | 7/1992 | Lane | |
| 5,151,100 | A | | 9/1992 | Abele et al. | |
| 5,230,349 | A | | 7/1993 | Langberg | |
| 5,354,220 | A | | 10/1994 | Ganguly et al. | |
| 5,372,603 | A | | 12/1994 | Acker et al. | |
| 5,542,928 | A | | 8/1996 | Evans et al. | |
| 5,562,633 | A | | 10/1996 | Wozencroft | |
| 5,566,221 | A | | 10/1996 | Smith et al. | |
| 5,591,162 | A | | 1/1997 | Fletcher et al. | |
| 5,599,346 | A | | 2/1997 | Edwards et al. | |
| 5,704,914 | A | | 1/1998 | Stocking et al. | |
| 5,718,688 | A | | 2/1998 | Wozendroft | |
| 5,782,740 | A | | 7/1998 | Schneiderman | |
| 5,793,272 | A | | 8/1998 | Burghartz et al. | |
| 5,795,339 | A | | 8/1998 | Erskine | |
| 5,816,999 | A | | 10/1998 | Bischoff et al. | |
| 5,865,806 | A | | 2/1999 | Howell | |
| 6,108,402 | A | * | 8/2000 | Chronenky | 378/119 |

FOREIGN PATENT DOCUMENTS

| | | |
|---|---|---|
| WO | 97/07740 | 3/1997 |
| WO | 98/48899 | 11/1998 |
| WO | 00/09212 | 2/2000 |

* cited by examiner

*Primary Examiner*—Robert H. Kim
*Assistant Examiner*—Hoon K. Song
(74) *Attorney, Agent, or Firm*—Fulbright & Jaworski L.L.P.

(57) ABSTRACT

A heat exchanger removes heat generated by a miniaturized x-ray source to help remove heat at the site of x-ray generation.

5 Claims, 4 Drawing Sheets

HEAT SINK FOR MINIATURE X-RAY UNIT

FIELD OF THE INVENTION

The invention relates to a heat sink for a miniaturized x-ray unit which channels away heat from the X-ray source during operation.

BACKGROUND AND SUMMARY OF THE INVENTION

Traditionally, x-rays have been used in the medical industry to view bone, tissue and teeth. X-rays have also been used to treat cancerous and precancerous conditions by exposing a patient to x-rays using an external x-ray source. Treatment of cancer with x-rays presents many well documented side effects, many of which are due to the broad exposure of the patient to the therapeutic x-rays.

Minimally invasive endoscopic techniques have been developed and are used to treat a variety of conditions. Endoluminal procedures are procedures performed with an endoscope, a tubular device into the lumen of which may be inserted a variety of rigid or flexible tools to treat or diagnose a patient's condition.

The desire for improved minimally invasive medical devices and techniques have led to the development of miniaturized x-ray devices that may be used in the treatment or prevention of a variety of medical conditions. International Publication No. WO 98/48899 discloses a miniature x-ray unit having an anode and cathode separated by a vacuum gap positioned inside a metal housing. The anode includes a base portion and a projecting portion. The x-ray unit is insulated and connected to a coaxial cable which, in turn, is connected to the power source. An x-ray window surrounds the projecting portion of the anode and the cathode so that the x-rays can exit the unit. The x-ray unit is sized for intra-vascular insertion, and may be used, inter alia, in vascular brachytherapy of coronary arteries, particularly after balloon angioplasty.

International Publication No. WO 97/07740 discloses an x-ray catheter having a catheter shaft with an x-ray unit attached to the distal end of the catheter shaft. The x-ray unit comprises an anode and a cathode coupled to an insulator to define a vacuum chamber. The x-ray unit is coupled to a voltage source via a coaxial cable. The x-ray unit can have a diameter of less than 4 mm and a length of less than about 15 mm, and can be used in conjunction with coronary angioplasty to prevent restenosis.

U.S. Pat. No. 5,151,100 describes a catheter device and method for heating tissue, the device having a catheter shaft constructed for insertion into a patient's body, and at least one chamber mounted on the catheter shaft. The catheter shaft has at least one lumen for fluid flow through the shaft. Walls that are at least in part expandable define the chambers. Fluid flows, through the lumens, between e chambers and a fluid source outside the body. The chambers can be filled with the fluid after they have been placed within the body. A heating device heats liquid within at least one of the chambers, so that heat is transmitted from the liquid to surrounding tissue by thermal conduction through the wall of the chamber. Means are provided for selectively directing heat transmission toward a selected portion of surrounding tissue. The chambers are fillable with fluid separately from each other, so that the chambers can occupy any of a plurality of possible total volumes. By selecting the total volume of chambers, compression of the tissue can be controlled, and hence the effectiveness of transfer of heat to the tissue can be controlled. According to the method, the catheter device is used to heat tissue from within a duct in a patient's body. The chambers are inserted into the duct and filled with fluid. Liquid is heated within at least one of the chambers, and heat is selectively directed toward a selected portion of surrounding tissue.

U.S. Pat. No. 5,542,928 describes a thermal ablation catheter includes an elongate body member having a heating element disposed over a predetermined length of its distal end or within an axial lumen. The heating element is suspended away from an exterior surface of the elongate member to form a circulation region thereunder. Alternatively, the heating element is distributed over some or all of the axial lumen. Thermally conductive fluid can be introduced through the lumen in the elongate member and ifito the circulation region to effect heat transfer. The catheter is used to introduce the thermally conductive medium to a hollow body organ where the heating element raises the temperature of the medium sufficiently to induce injury to the lining of the organ. Optionally, an expandable cage in the catheter or on an associated introducer sheath may be used in combination with a thermal ablation catheter. The expandable cage helps center the heating element on the catheter within the body organ and prevents direct contact between the heating element and the wall of the organ. When disposed on the catheter, the cage can be useful to position a flow directing element attached to the flow delivery lumen of the catheter. Heat transfer and temperature uniformity can be enhanced by inducing an oscillatory flow of the heat transfer medium through the catheter while heat is being applied.

U.S. Pat. No. 5,230,349 discloses a catheter having the active electrode is partially covered by a heat conducting and electrically insulating heat-sink layer for localizing and controlling an electrical heating of tissue and cooling of the active electrode by convective blood flow. The '349 patent also describes a current equalizing coating for gradual transition of electrical properties at a boundary of a metallic active electrode and an insulating catheter tube. The current equalizing coating controls current density and the distribution of tissue heating.

U.S. Pat. No. 4,860,744 discloses a system and method are disclosed for providing precisely controlled heating (and cooling) of a small region of body tissue to effectuate the removal of tumors and deposits such as atheromatous plaque, without causing damage to healthy surrounding tissue, e.g. arterial walls. Such precisely controlled heating is produced through thermoelectric and resistive heating, and thermoelectric control of a heated probe tip. The system includes a probe tip with N-doped and P-doped legs of semiconductor material, a catheter to which the probe tip is attached for insertion into a patient's body, and a system control mechanism. The probe may be used for reduction and/or removal of atheromatous obstruction in arteries or veins. It may also be used for destruction of diseased tissue and/or tumors in various parts of the body, such as the brain or the bladder. The probe may be configured for either tip heating or for side heating.

U.S. Pat. No. 5,591,162 describes a catheter that provides precise temperature control for treating diseased tissue. The catheter may use a variety of passive heat pipe structures alone or in combination with feedback devices. The catheter is particularly useful for treating diseased tissue that cannot be removed by surgery, such as a brain tumor.

Miniaturized x-rays are not foolproof, however, and still present difficulties, because the x-ray unit generates heat which can damage adjacent tissue.

The present invention is a heat sink to be used with, e.g., an endoscopic x-ray device, to remove heat generated at the site of treatment, minimizing damage to surrounding tissues.

The device is sized to fit within the design constraints of miniaturized systems.

Other features of the present inventions will become readily apparent from the detailed description and drawings.

BRIEF DESCRIPTION OF THE DRAWINGS

The following detailed description, given by way of example, and not intended to limit the present invention solely thereto, will be best be understood in conjunction with the accompanying drawings.

DETAILED DESCRIPTION OF THE INVENTION

The present invention relates to a heat exchanger preferably prepared using Very Large Scale Integration (VLSI) silicon processing. A heat exchanger substrate that is able to absorb the heat has thermal characteristics allowing the device to quickly absorb and transfer heat away from the site of heat generation, e.g., at an x-ray source. Copper is well suited for this function. The heat exchanger has a flow channel defined therein.

Figure 3:
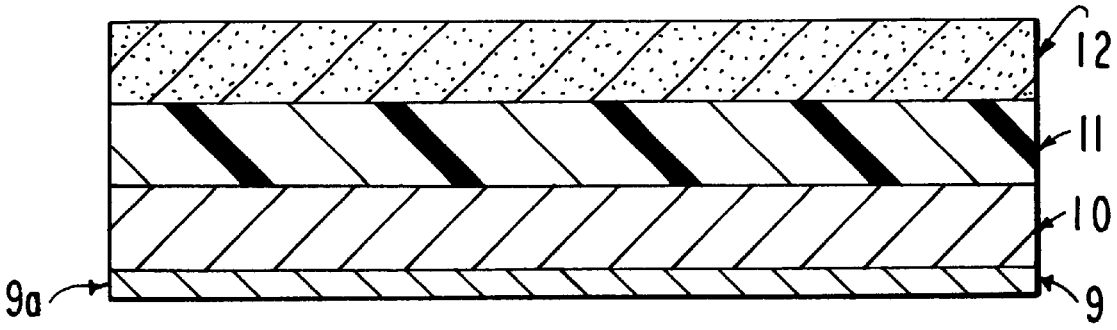
FIGS. 3–8 shows the stepwise production of a heat exchanger from a multilayer substrate.

Construction and manufacture of the heat exchanger is shown in FIGS. 3–8. Referring to FIG. 3, copper layer 10 is plated adjacent a defined region of metal substrate, preferably gold, that is optionally coated or plated (9*a*) with a metal such as gold or silver which is used as collector plate 9. The technique of plating or electroplating involves the immersion of the material to be added (e.g., copper) and the substrate in an electrolyte solution. Sputtering can also be used to coat collector 9 with a layer of metal which may be the same or different as the metal of collector 9. Current is forced to flow in the direction that causes ions to be attracted to the substrate. Plating is particularly useful in the formation of thick metal layers, such as copper.

Insulator 11 is deposited on the surface of the copper layer 10. Preferably, the insulator 11 is silicon dioxide. A photoresist 12 is then deposited on the insulator 11. Typically, the photoresist is an organic polymer that is sensitive to light or electron beams.

Figure 4:
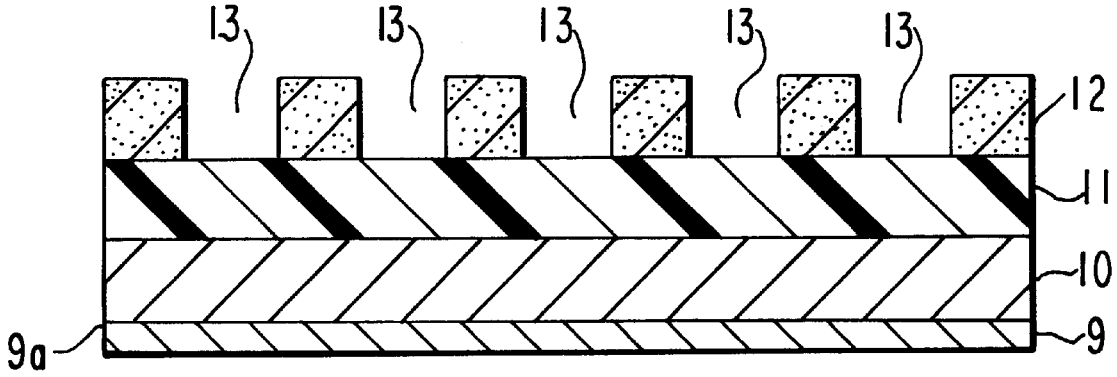

Photoresist 12 is selectively exposed to define a channel pattern using conventional optical (or imaging) techniques or electron beam machine to form imaged and non-imaged areas. Either of the imaged or non-imaged areas may define a series of interconnected channels 13 that form the fluid conduits as shown in FIG. 4.

Figure 5:
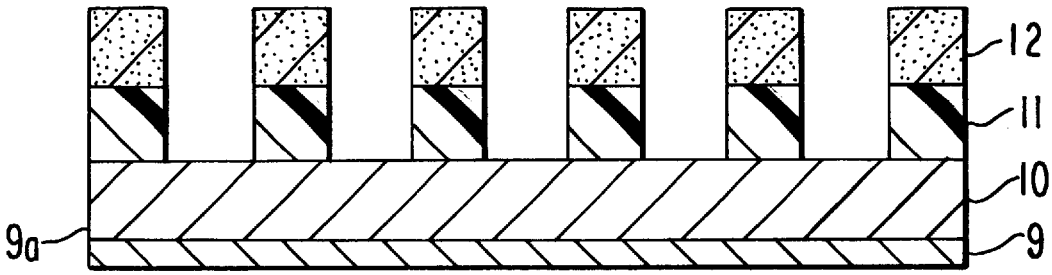

Imaged or non-imaged regions of photoresist 12 are then removed and the portion that remains is used to mask insulator 11 from etching such as plasma, sputtering, and reactive ion etching (RIE) (FIG. 5). Plasma, sputtering, and RIE are variations on a general process in which gas is excited by RF or dc means and the excited ions remove the insulator 11 at the exposed regions, i.e, those not covered by photoresist 12. With sputter etching, the gas is inert and removes material mechanically. In plasma etching the gas is chemically active and removes material more or less isotropically as in chemical or wet etching. RIE is a sputtering which uses chemically active ions. The advantage of RIE is that electric fields cause the ions to impinge the surface vertically. This causes anisotropic etching with steep vertical walls needed for very fine linewidths.

Figure 6:
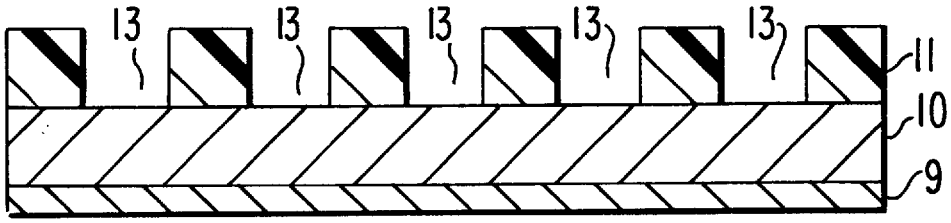

The remaining photoresist 12 is then stripped or removed, e.g. by laser ablation or with a suitable solvent, as shown in FIG. 6, leaving insulating layer 11 with a series of interconnecting channels 13 therein.

Figure 7:
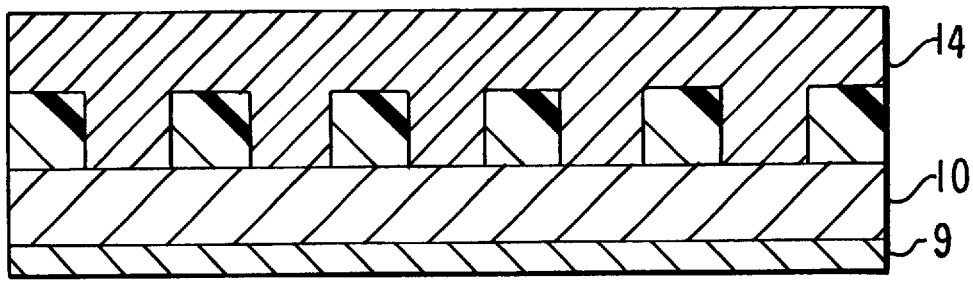
Figure 8:
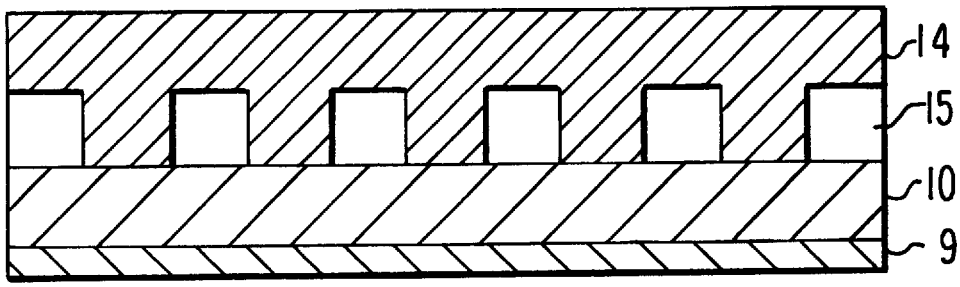

A copper or other suitable metal layer 14 is then electroplated up and around the remaining insulator 11 as shown in FIG. 7, forming in essence, a continuous metal layer with layer 10 but having insulating portions 11 running therethrough. Special access holes (not shown), are used to etch away insulator selective to copper as shown in FIG. 8. Typically chemical or (wet) etching is used because of excellent selectivity. Selectivity refers to the propensity for the etching to etch the material one wants to remove rather than the material one does not want to remove. For example, if the insulator is silicon dioxide ($SiO_2$), dilute hydrofluoric acid is the preferred etching agent. Removal of the insulator defines the conduit 15.

Figure 9:
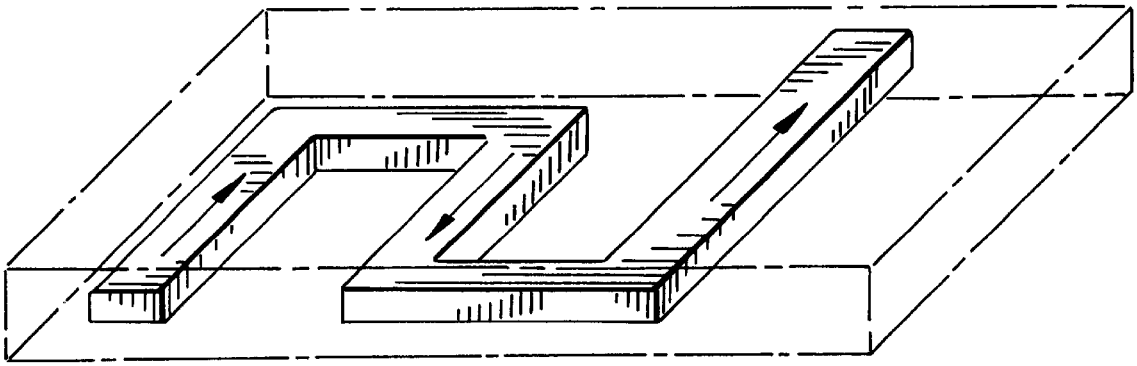
FIG. 9 is a detail of the flow channel within a heat exchanger of the invention, showing direction of flow.
Figure 10:
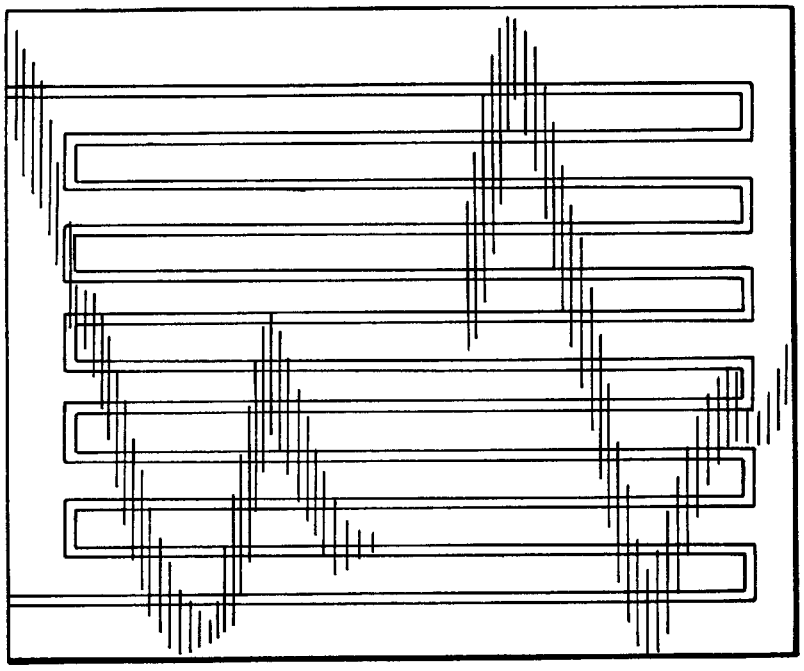
FIG. 10 is a top view of the heat exchanger through the center of the device, showing the path of the flow channel.

FIG. 9 (isometric view) and FIG. 10 (top down view) show the resultant channel in detail. The channels are defined in the substrate, and fluids circulate therein. The substrate is attached directly to the collector, which preferably formed as part of the x-ray tube.

Figure 1:
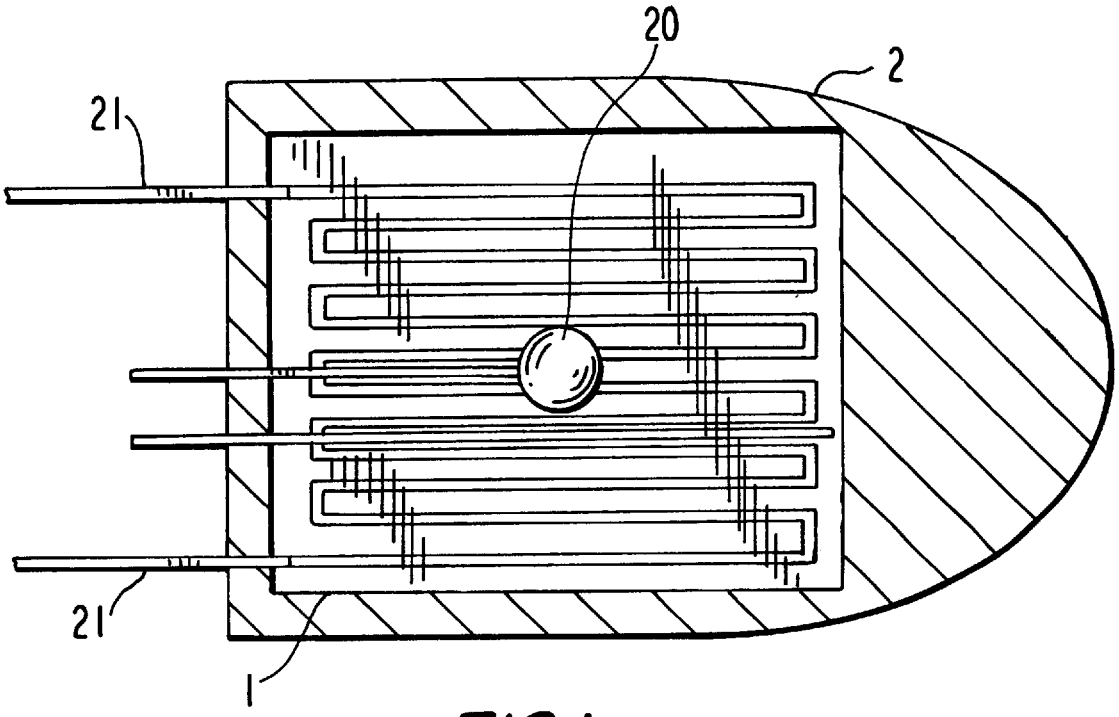
FIG. 1 is an isometric view of a preferred heat exchanger according to the invention.

As shown in FIG. 1 collector 1 with its fluid channels is manufactured as part of the x-ray tube that also contains the x-ray source 20. Conduits 21 for the fluids are made simultaneously with the channels of the heat exchanger. These conduits are an extension of the channels, and are made of copper and therefore can have the x-ray tube glass formed around them. The collector is shown as transparent in FIG. 1 so that the fluid channels can be seen. The collector 1 is located between x-ray source 20 and the substrate channels, as seen in FIG. 2.

Figure 2:
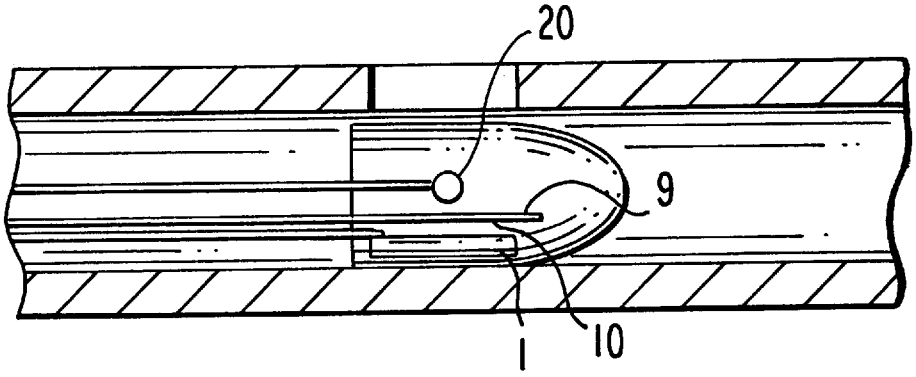
FIG. 2 is a miniaturized x-ray device according to the invention, showing the position of the heat exchanger.

The x-ray tube is inside a section of the catheter as seen in FIG. 2.

The heat itself will actively pump the fluid through the channel. However, for faster removal active pumps (not shown) can be used and are connected to the channels. The cooling fluid is preferably water or other high heat capacity fluid. Vacuum is great insulator in and of itself, so the lowest resistance path, i.e., the active heat exchange system will be followed. This heat exchanger system will carry most of the heat generated by the x-ray away from the site of x-ray generation.

The heat collectors of the invention preferably range from 1 to 15 mm in length and/or width. Preferably the heat sink is from 1 to 15 mm thick. The collector can be made of other material provided the materials have high heat transference capable of providing the desired result.

In the spirit of this invention, there could be "other means" for connecting a heat transfer system right on the collector inside the x-ray vacuum tube. For instance a Peltier Cooling System, or a radiation (heat fins) or convection system. These and other related ideas are considered within scope and spirit of this invention.

The heat exchanger of the invention can be used in any application where a miniaturized heat exchanger is required.

While the present invention has been particularly described with respect to the illustrated embodiment, it will be appreciated that various alterations, modifications and adaptations may be made on the present disclosure, and are intended to be within the scope of the present invention. It is intended that the appended claims be interpreted as including the embodiment discussed above, those various alternatives, which have been described, and all equivalents thereto.

All cited references are incorporated herein by reference.

It is claimed:

1. An x-ray device having a heat exchanger operable inside a catheter, comprising:

an x-ray source comprising an x-ray tube;

a collector for collecting heat energy released by the x-ray source; and a heat exchanger comprising a metal collector having a top face and a bottom face; a first metal layer adjacent the top face of said metal collector; and a second metal layer adjacent said first metal layer, the first and second metal layers having a channel formed therethrough for circulating a heat exchange fluid, the channel having an infeed and an exit end through which cooling fluid may enter and exit the channel;

wherein said heat exchanger is formed on said collector for absorbing and removing heat from said collector.

2. The x-ray device of claim 1, wherein said heat exchanger comprises channels therein.

3. The x-ray device of claim 2, wherein said collector includes fluid channels for holding fluid to absorb and transfer heat from said x-ray device.

4. An x-ray device having a heat exchanger operable inside a catheter, comprising:

an x-ray source; and a heat exchanger for absorbing and removing heat generated from said x-ray source, the heat exchanger having a collector thereon, wherein said collector is positioned between said x-ray source and said heat exchanger, wherein the heat exchanger comprising a metal collector having a top face and a bottom face; a first metal layer adjacent the top face of said metal collector; and a second metal layer adjacent said first metal layer, the first and second metal layers having a channel formed therethrough for circulating a heat exchange fluid, the channel having an infeed and an exit end through which cooling fluid may enter and exit the channel.

5. The x-ray device of claim 1, wherein the collector comprises a metal.

* * * * *

UNITED STATES PATENT AND TRADEMARK OFFICE

CERTIFICATE OF CORRECTION

PATENT NO. : 6,546,080 B1
DATED : April 8, 2003
INVENTOR(S) : Kurt A. Edward

It is certified that error appears in the above-identified patent and that said Letters Patent is hereby corrected as shown below:

Title page,
Item [75], Inventors, please add -- Michael S. Banik, Bolton, MA (US) --

Signed and Sealed this

Seventeenth Day of August, 2004

JON W. DUDAS
*Acting Director of the United States Patent and Trademark Office*